United States Patent [19]

Thomas

[11] 4,328,628

[45] May 11, 1982

[54] SNOW PLOUGH ASSEMBLY FOR A FRONT END LOADER

[76] Inventor: Bernard N. Thomas, P.O. Box 8, Alban, Ontario, Canada, P0M 1A0

[21] Appl. No.: 155,775

[22] Filed: Jun. 2, 1980

[30] Foreign Application Priority Data

Sep. 10, 1979 [CA] Canada ..... 335328

[51] Int. Cl.[3] ..... E02F 3/62

[52] U.S. Cl. ..... 37/117.5; 37/41; 414/912

[58] Field of Search ..... 37/41, 42 R, 42 VL, 37/50, 117.5, DIG. 3; 172/819, 820, 821, 822, 724; 414/745, 912

[56] References Cited

U.S. PATENT DOCUMENTS

| | | | |
|---|---|---|---|
| 2,312,390 | 3/1943 | Cordes | 37/117.5 |
| 2,488,695 | 11/1949 | Upton | 37/117.5 |
| 2,903,803 | 9/1959 | Austin, Sr. | 37/117.5 |
| 2,986,826 | 6/1961 | Timmons | 37/117.5 |
| 3,230,645 | 1/1966 | Lutz | 37/117.5 |
| 3,508,676 | 4/1970 | Peterson | 37/117.5 |
| 3,665,622 | 5/1972 | Lamb | 37/42 R |
| 3,706,144 | 12/1972 | Miceli | 37/42 R |
| 3,866,342 | 2/1975 | Cooper | 37/117.5 |
| 3,987,562 | 10/1976 | Deen et al. | 37/42 R |
| 4,076,080 | 2/1978 | Anderson | 37/117.5 |
| 4,083,414 | 4/1978 | Yokoyama et al. | 172/820 |

FOREIGN PATENT DOCUMENTS

| | | | |
|---|---|---|---|
| 2249268 | 4/1974 | Fed. Rep. of Germany | 37/117.5 |
| 456589 | 11/1936 | United Kingdom | 37/117.5 |

*Primary Examiner*—E. H. Eickholt
*Attorney, Agent, or Firm*—Ridout & Maybee

[57] ABSTRACT

A front end loader having a vertically moveable forwardly concave implement such as a bucket or log grapple, is provided with a snow plough accessory which is readily attachable to and detachable from the implement, the accessory having a blade which can be swung from side to side.

7 Claims, 5 Drawing Figures

SNOW PLOUGH ASSEMBLY FOR A FRONT END LOADER

BACKGROUND OF THE INVENTION

1. Field of the Invention

This invention relates to a snow plough accessory for attachment to a forwardly concave implement of a front end loader. For example, the accessory may be attached to the bucket or log grapple of a front end loader.

2. Description of the Prior Art

A conventional front end loader equipped with a bucket cannot efficiently clear snow since it is designed for a scooping operation rather than ploughing. If the operator wishes to equip his machine with a snow plough blade, he may remove the bucket and attach a suitable blade in its place. The idea of attaching a blade in front of the bucket of a front end loader is not new. U.S. Pat. Nos. 3,866,342 issued Feb. 18, 1975 to George R. Cooper and 2,986,826 issued June 6, 1961 to Adolph Timmons, both describe means for attaching a blade accessory in front of the bucket. However, these arrangements are not entirely satisfactory as to ease of attachment or manipulation.

SUMMARY OF THE INVENTION

The present invention provides an adjustable snow plough blade accessory which can be quickly and easily attachable to a forwardly concave implement of a front end loader. The invention consists of a snow plough blade, a blade supporting frame extending rearwardly of the blade, the frame having a rearwardly facing channel structure into which the lower portion of the implement is insertable to push the blade, and a connector arm extendible upwardly and rearwardly of the blade for connection of the frame to an upper part of the implement.

More specifically, the invention consists of a front end loader having a forwardly concave implement, means for elevating the implement, and a snow plough accessory fixed to the implement, the accessory comprising a snow plough blade, a blade-supporting frame comprising a pair of cantilever beams pivotally connected to the rear of the blade about a vertical axis and diverging rearwardly and radially of said axis and then extending rearwardly parallel to each other, the parallel portions of the beam having rearwardly facing channel structures for receiving the lower portion of the implement, a semi-circular beam fixed to the rear of the blade concentric with said axis and slidably supported by the radial portions of the cantilever beams, remotely controllable reciprocatable cylinders pivotally supported on the parallel portions of the cantilever beams and coupled to the semicircular beam to swing the blade about said axis, and a connector arm pivotally connected at one end to the frame adjacent its connection to the blade, the connector arm at its other end being connected to an upper part of the implement.

BRIEF DESCRIPTION OF THE DRAWINGS

Two preferred embodiments of the invention are shown in the accompanying drawings in which.

DESCRIPTION OF THE PREFERRED EMBODIMENT

Figure 2:
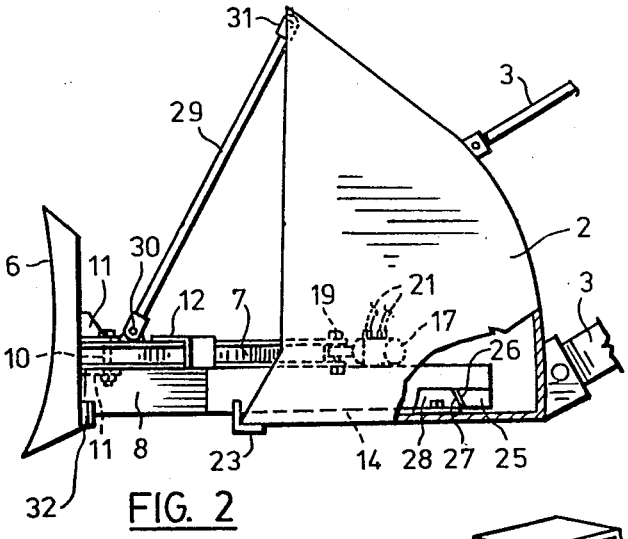
FIG. 2 is an enlarged side view of the bucket with the accessory attached.
Figure 1:
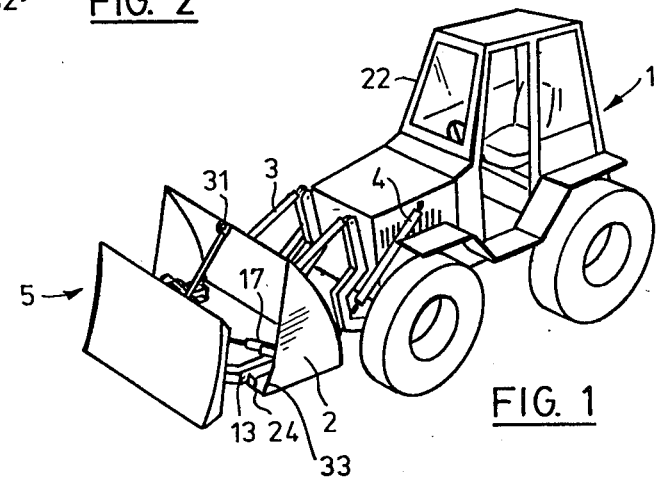
FIG. 1 is a perspective view of a conventional front end loader with a snow plough accessory attached to a bucket.

FIG. 1 shows a front end loader 1 having a bucket 2 which can be raised and lowered by conventional mechanism 3 operated by cylinders 4. Attached to the bucket 2 is a snow plough accessory 5, the details of which are shown in FIGS. 2 and 3.

Figure 3:
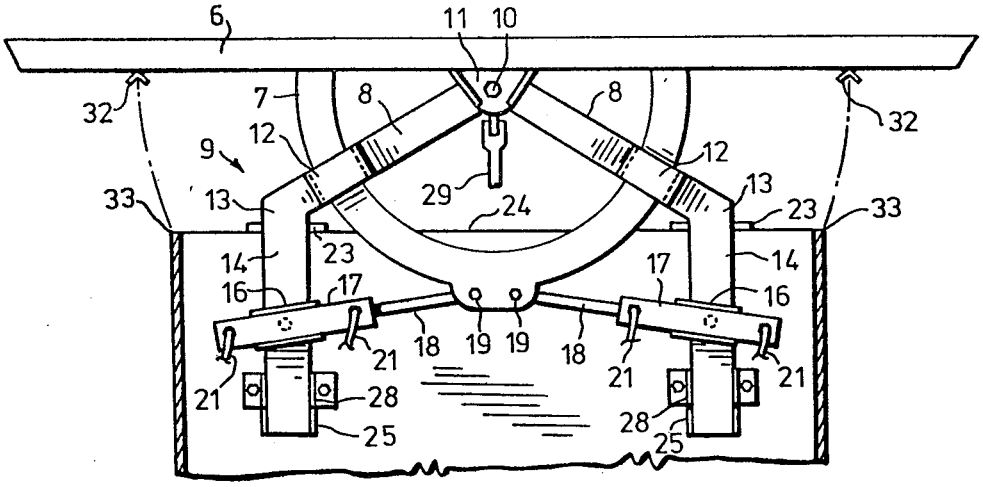
FIG. 3 is a plan view of the accessory attached to the bucket.

As best seen in FIG. 3, a snow plough blade 6 has rigidly attached to its rear face a semicircular beam 7. Radiating from the centre of the semicircle defined by the beam are angular portions 8 of a blade-supporting frame 9. The frame 9 and blade 6 are pivotally connected by means of a bolt or pin 10 which passes vertically through the frame and through brackets 11 fixed to the blade midway along its length, whereby the blade can swing horizontally relative to the frame. The beam 7 is slidably supported on the radial portions 8 of frame 9, the beam passing through guides 12 fixed to the radial portions 8.

The radial portions 8 constitute the forward portions of a pair of beams 13 which have parallel rearward portions 14. Pivoted on these rearward portions are brackets 16 which carry hydraulic cylinders 17. Piston rods 18 of the cylinders are pivotally connected at 19 to the semicircular beam 7. The action of cylinders 17 can be remotely controlled through hoses 21 that can quickly be coupled to lines (not shown) running to the operator's cab 22, whereby the blade 6 and beam 7 can be swung horizontally about the pivot pin 10.

Secured to the undersides of the parallel portions 14 of beams 13 are rearwardly facing angle irons 23. With the beams 13 these angle irons define rearwardly facing channel structures which receive the lower lip 24 of the bucket 2. The beams 13 have, at their rearward ends, abutments 25 with forwardly facing surfaces 26 which engage rearwardly facing surfaces 27 of corresponding abutments 28 fixed to the bottom of the bucket 2. Final securement of the frame 9 to the bucket is achieved by a connector arm 29, which is pivotally connected to the frame 9 about a horizontal pin 30 near the vertical pin 10, the arm 29 being connected at 31 to an upper part of the bucket 2 by a simple hook or pin connection. The arm 29 may be of adjustable length.

Angle iron brackets 32 are attached to the rear face of blade 6 to engage bottom corners 33 of the bucket 2 when blade 6 is fully angled about pivot pin 10. Brackets 32, when thus engaged, serve as bumpers which assist in absorbing any sudden shock which might occur during a ploughing operation, thereby alleviating to some extent stress on cylinders 17 and frame 9.

The snow plough accessory 5 can quickly be attached to the bucket 2 by the operator of the front end loader, working alone. The operator drives the loader to maneuver the lip 24 of the bucket under the frame 9 of the accessory. As he slides the lip 24 forwardly under the frame he lifts the bucket slightly to tilt the frame so that the abutments 25 can pass over the abutments 28 on the bucket, and when the bucket lip 24 enters the channel structure 23 he allows the abutments 25 to drop or hook behind the abutments 28 so that the beams 13 rest on the bottom of the bucket. Then he engages the connector arm 29 with the upper portion of the bucket at 31, and connects the hoses 21 to the abovementioned lines running to his cab.

With the accessory connected to the bucket, the lower lip 24 pushes against the channel structure at 23 during a ploughing operation. When the loader is backing up, the connector arm 29 prevents the rear of the frame 9 from lifting and therefore engagement of the abutments 28, 25 draws the accessory rearwardly. The blade can be swung horizontally by actuating the cylinders 17 from the driver's cab 22. The accessory can be lifted upwardly by raising the bucket, if it is desired to push the top of a pile of snow, or the bottom of the blade 6 can be raised over the top of a pile and then lowered so that the top of the pile can be pushed either forwardly ahead of the blade or rearwardly behind it. Thus, the blade is highly maneuverable, and the operator has good visibility. Snow may also collect in the bucket and be lifted and dumped because there is ample clearance between the blade 6 and bucket 2.

When the bucket is lifted, the forward lip 24 of the bucket is held in the channel structure by the beams 13 which form upper horizontal legs of the channel structure, and similarly the bottom portions of the angle irons 23 form lower legs of the channel structure, preventing separation of the bucket from the accessory. Relative forward and rearward movement of the bucket and the accessory is prevented by the engagement of the bucket in the channel structure and by the abutments 25, 28. However, it is a simple matter to disconnect the accessory from the bucket by disconnecting the hoses 21, undoing the connection 31, and then tilting the bucket so that the abutments 25, 28 are disengaged and the bucket can be withdrawn from the channel structure.

Figure 4:
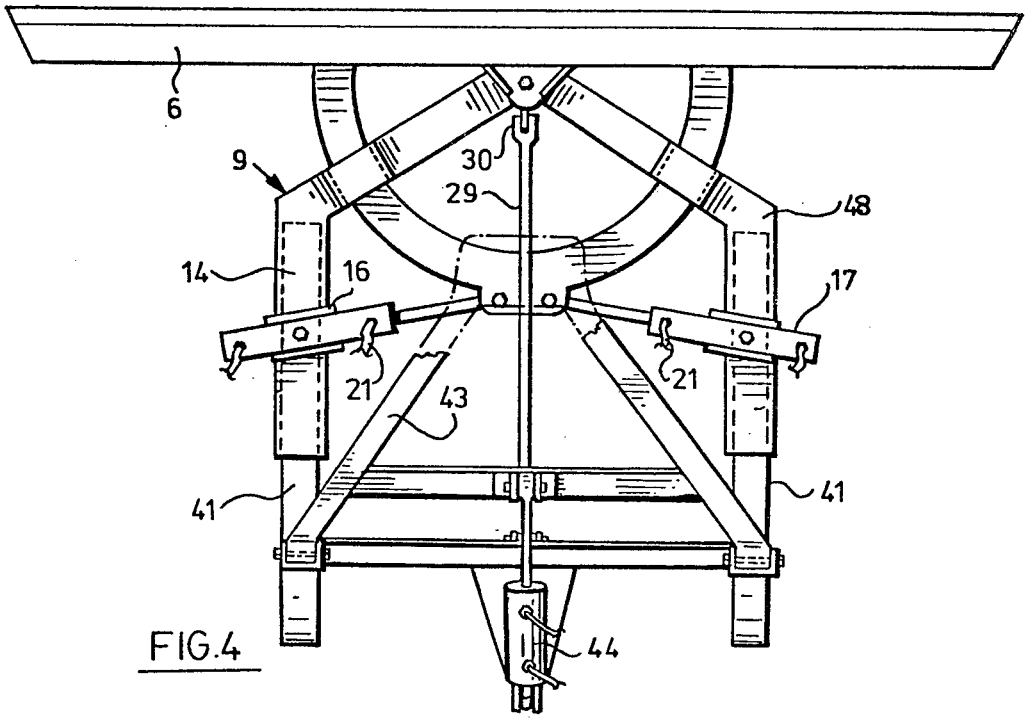
FIG. 4 is a plan view of the accessory attached to a log grapple.
Figure 5:
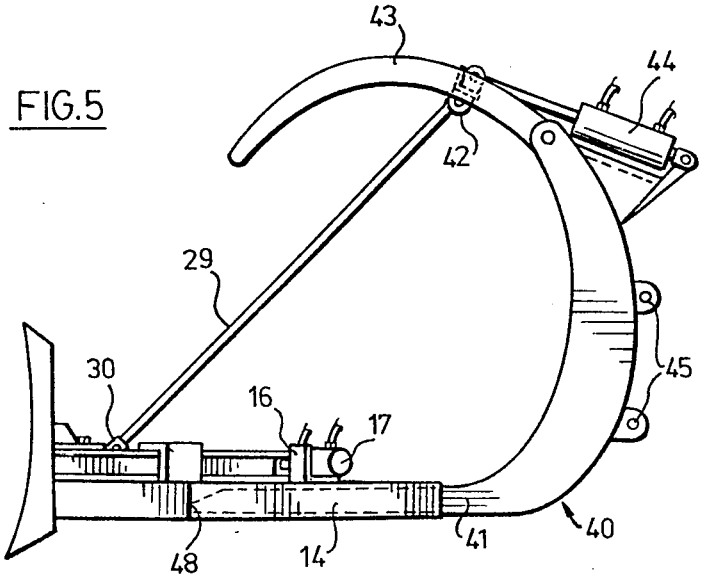
FIG. 5 is a side view of a log grapple with the accessory attached.

Referring to FIGS. 4 and 5, a variant of the snow plough accessory may be used for attachment to a log grapple 40 of a front end loader. The blade 6 and frame 9 may be identical to those already described. The parallel rearward beam portions 14 are open ended thereby providing channel structure into which are inserted lower arms 41 of a conventional log grapple 40. The frame 9 is secured to the grapple 40 by an adjustable connector arm 29, pivotally connected at 30 to the frame 9, the arm 29 being connected at 42 to an upper part of the grapple by a simple hook or pin connection. The grapple has a conventional upper arm 43 that can be remotely controlled by a cylinder 44, the lower arms being connectable by eyes 45 to the manipulation mechanism 3 of the front end loader.

The snow plough accessory can be quickly attached to the log grapple simply by maneuvering the lower arms 41 into the channel structures defined by beam portions 14, and then engaging arm 29 with the upper portion of the grapple at 42. Hoses 21 of cylinders 17 are connected to lines running to operator's cab 22 by means of quick coupling devices. Said hose lines may be disconnected from cylinder 44, thus freeing them for use in operating cylinders 17.

With the accessory connected, the lower arms 41 push against the channel structure at 48 during a ploughing operation. The length of the channel structure and the attachment of arm 29 prevents disengagement of the accessory when the loader is backing up. The blade 6 is fully functional as described when attached to a bucket. The accessory may be easily disconnected simply by reversing the connection steps outlined above.

Modifications to the preferred embodiments will readily occur to those skilled in the art.

I claim:

1. A front end loader having a forwardly concave implement, means for elevating the implement, and a snow plough accessory fixed to the implement, the accessory comprising a snow plough blade, a blade-supporting frame comprising a pair of cantilever beams pivotally connected to the rear of the blade about a vertical axis and diverging rearwardly and radially of said axis and then extending rearwardly parallel to each other, the parallel portions of the beam having rearwardly facing channel structures for receiving the lower portion of the implement, a semicircular beam fixed to the rear of the blade concentric with said axis and slidably supported by the radial portions of the cantilever beams, remotely controllable reciprocatable cylinders pivotally supported on the parallel portions of the cantilever beams and coupled to the semicircular beam to swing the blade about said axis, and a connector arm pivotally connected at one end to the frame adjacent its connection to the blade, the connector arm at its other end being connected to an upper part of the implement.

2. A snow plough accessory for attachment to a forwardly concave bucket which is provided on a front end loader and is maneuverable thereby, comprising a snow plough blade, a blade-supporting frame extending rearwardly of the blade, the frame having a rearwardly facing channel structure into which a lower portion of the bucket is insertable to push the blade and a connector arm extendable upwardly and rearwardly of the blade for connection of the frame to an upper part of the bucket, the blade having a pivotal connection to the frame, the frame supporting means for swinging the blade horizontally about said connection, the blade having attached to the rear face thereof bumpers for engaging the bucket when the blade is swung to its extreme horizontal position.

3. A snow plough accessory for attachment to a forwardly concave bucket which is provided on a front end loader and is maneuverable thereby comprising a snow plough blade, a blade-supporting frame extending rearwardly of the blade, the frame having a rearwardly facing channel structure into which a lower portion of the bucket is insertable to push the blade, a connector arm extendable upwardly and rearwardly of the blade for connection of the frame to an upper part of the bucket, means rearward of the channel structure to extend into the bucket and prevent the bucket from becoming dislodged from the channel structure, said means rearward of the channel structure comprising a forwardly facing abutment structure on the frame for engagement with rearwardly facing abutment structure fixed to the inside bottom of the bucket.

4. An accessory as claimed in claim 3, wherein the frame comprises a pair of rearwardly extending supporting beams adapted to extend into the bucket and to rest on the bottom of the bucket, with the channel structure at the undersides of the beams and the abutment structure adjacent their rearward ends.

5. A snow plough accessory for attachment to a forwardly concave log grapple which is provided on a front end loader and is maneuverable thereby, comprising a snow plough blade, a blade-supporting frame extending rearwardly of the blade, the frame having a rearwardly facing channel structure into which a lower portion of the grapple is insertable to push the blade, a connector arm extendable upwardly and rearwardly of the blade for connection of the frame to an upper part of the grapple, the frame comprising a pair of rearwardly extending supporting beams forming channel structures into which lower arms of the log grapple are insertable.

6. A snow plough accessory for attachment to a forwardly concave implement which is provided on a front end loader and is maneuverable thereby, comprising a snow plough blade, a blade-supporting frame extending rearwardly of the blade, the frame having a rearwardly facing channel structure into which a lower portion of the implement is insertable to push the blade, a connector arm extendable upwardly and rearwardly of the blade for connection of the frame to an upper part of the implement, the frame comprising a pair of supporting beams extending rearwardly from a pivotal connection at the rear of the blade, a semicircular beam fixed to the rear of the blade concentric with said pivotal connection, the blade and semicircular beam being swingable horizontally about said pivotal connection, the supporting beam having radial portions diverging from said pivotal connection and slidably supporting the swingable semicircular beam, and the supporting beams having parallel terminal portions incorporating said channel structure.

7. An accessory as claimed in claim 6, wherein remotely controllable cylinders are pivotally supported on said terminal portions and are coupled to the semicircular beam to swing the semicircular beam and blade.

* * * * *